US009045979B2

(12) United States Patent
Cobb et al.

(10) Patent No.: US 9,045,979 B2
(45) Date of Patent: Jun. 2, 2015

(54) DOWNHOLE GAS SEPARATOR AND METHOD

(71) Applicants: Delwin E. Cobb, Houston, TX (US); Roy Arterbury, Houston, TX (US)

(72) Inventors: Delwin E. Cobb, Houston, TX (US); Roy Arterbury, Houston, TX (US)

( * ) Notice: Subject to any disclaimer, the term of this patent is extended or adjusted under 35 U.S.C. 154(b) by 242 days.

(21) Appl. No.: 13/711,044

(22) Filed: Dec. 11, 2012

(65) Prior Publication Data

US 2014/0158343 A1 Jun. 12, 2014

(51) Int. Cl.
*E21B 43/38* (2006.01)
*E21B 43/12* (2006.01)

(52) U.S. Cl.
CPC ..... *E21B 43/38* (2013.01); *E21B 43/127* (2013.01)

(58) Field of Classification Search
CPC ..... E21B 43/38; E21B 17/00; E21B 29/06; E21B 43/128; E21B 43/127; B01D 19/0052; B01D 21/0042; B01D 21/267; F04D 9/003
USPC ..... 166/105.1, 105.5, 265, 105.3; 96/216; 55/406, 456
See application file for complete search history.

(56) References Cited

U.S. PATENT DOCUMENTS

| | | | | |
|---|---|---|---|---|
| 1,628,900 | A | 5/1927 | Neilsen | |
| 2,229,541 | A | 1/1941 | Zublin | |
| 2,843,053 | A | 7/1958 | Carle | |
| 3,128,719 | A * | 4/1964 | Jongbloed et al. | 166/105.5 |
| 3,386,390 | A | 6/1968 | Fair | |
| 4,074,763 | A | 2/1978 | Stevens | |
| 4,481,020 | A * | 11/1984 | Lee et al. | 96/214 |
| 4,531,584 | A | 7/1985 | Ward | |
| 5,314,018 | A * | 5/1994 | Cobb | 166/265 |
| 5,389,128 | A | 2/1995 | Lopes | |
| RE35,454 | E * | 2/1997 | Cobb | 166/265 |
| 5,794,697 | A | 8/1998 | Wolflick et al. | |
| 5,810,081 | A | 9/1998 | Cobb et al. | |
| 6,283,204 | B1 | 9/2001 | Brady et al. | |
| 6,382,317 | B1 | 5/2002 | Cobb | |
| 6,568,475 | B1 | 5/2003 | Grubb et al. | |
| 6,723,158 | B2 * | 4/2004 | Brown et al. | 96/214 |
| 7,104,321 | B2 | 9/2006 | Carruth | |
| 7,673,684 | B2 | 3/2010 | Cobb | |
| 2010/0175869 | A1 | 7/2010 | Cobb | |

FOREIGN PATENT DOCUMENTS

WO WO/2012/054256 A2 4/2012

OTHER PUBLICATIONS

Author: Unknown, Title: Poseidon Multiphase Gas-Handling System, Date: Unknown, Country: USA.

(Continued)

*Primary Examiner* — Daniel P Stephenson
(74) *Attorney, Agent, or Firm* — Streets & Steele; Patrick K. Steele; Jeffrey L. Streets

(57) ABSTRACT

A downhole separator (10) separates gas from well fluids which are pumped intermittently to the surface. The separator includes an outer tubular housing (12) and an inner flow tube (22) for passing well fluids to the surface after separation of the gas from the well fluids. A vortex flow generator or spiral gas separator (20) imparts a helical flow to effect separation of the gas from the well fluids. Gas from the gas chamber flows upward past the vortex flow generator when the pump is not pumping well fluids to the surface.

19 Claims, 4 Drawing Sheets

(56) References Cited

OTHER PUBLICATIONS

Author: Unknown, Title: Vortex Gas Separator, Date: Unknown, Country: USA.
Author: Unknown, Title: AGH Advanced Gas Handling Device, Date: Unknown, Country: USA.
Author: Unknown, (Dynamic Oil Tools, Inc.), Title: Downhole Gas Separator, Date: Unknown, Country: USA.
Authors: Lea, James F. and Winkler, Herald W., Title: What's New in Artificial Lift, Date: May 2011, Country: USA.
Author: Unknown, (Elder Oil Tools-Technical Unit), Title: Down Hole Gas Separator, Date: Mar. 1983, Country: USA.
Author: Unknown, (Integrated Production Services, Inc.), Title: Artificial Lift System, Date: Unknown, Country: USA.
International Search Report and the Written Opinion of the International Searching Authority; (ISA) International Searching Authority; Oct. 28, 2014.

* cited by examiner

DOWNHOLE GAS SEPARATOR AND METHOD

FIELD OF THE INVENTION

The present invention relates to a downhole gas separator of a type used in oil and gas wells to remove gas from well fluids before entering a reciprocating beam rod pump. In one embodiment, the invention relates to a combined gas separator and desander for removing both gas and solid particles from the well fluids before entering the pump.

BACKGROUND OF THE INVENTION

Various types of gas separators have been devised to reduce or eliminate gas from a fluid stream before entering a downhole pump which pumps liquids to the surface. Most wells are pumped by a reciprocating beam pump, which has a lift cycle followed by a plunger return cycle, so that liquids are intermittently pumped to the surface during the lift cycle.

Most wells contain both gas and sand or other solid particles, and both gas and sand are preferably reduced or eliminated so that they do not enter the intake to the pump, thereby prolonging the life and improving the efficiency of the pump.

A gas separator for an ESP pump is disclosed in U.S. Pat. No. 7,673,684. U.S. Pat. Re. 35,454, U.S. Pat. Nos. 5,810,081, 6,382,317, and 7,673,684 disclose relevant downhole separator technology.

Most gas separators or desanders are complex assemblies, and some such assemblies are 50 feet or more in length. The size, cost and complexity of these devices have limited their use in the oil and gas recovery industry.

The disadvantages of the prior art are overcome by the present invention, an improved down hole gas separator is hereinafter disclosed.

SUMMARY OF THE INVENTION

In one embodiment, the downhole separator supported on a tubular in a borehole separates gas from well fluids which are pumped intermittently to the surface. The downhole separator includes an outer tubular housing having openings therein to receive well fluids from an annulus radially exterior of the outer tubular housing. An inner flow tube secured to the tubular and having an open lower end passes upward flow of well fluids after separation of the gas from the well fluids. A vortex flow separator radially between the inner flow tube and the outer tubular housing receives the well fluids from the tubular housing openings and imparts a helical flow to effect separation of the gas from the well fluids. The gas accumulates in a chamber below the vortex flow generator and between the outer tubular housing and the inner flow tube when well fluids are pumped to the surface. Gas from the gas chamber flows upward past the vortex flow separator and exits the openings in the outer tubular housing when the pump is not pumping well fluids to the surface, i.e., during the plunger return cycle.

These and further features and advantages of the present invention will become apparent from the following detailed description, wherein reference is made to the figures in the accompanying drawings.

DETAILED DESCRIPTION OF PREFERRED EMBODIMENTS

Figure 1:
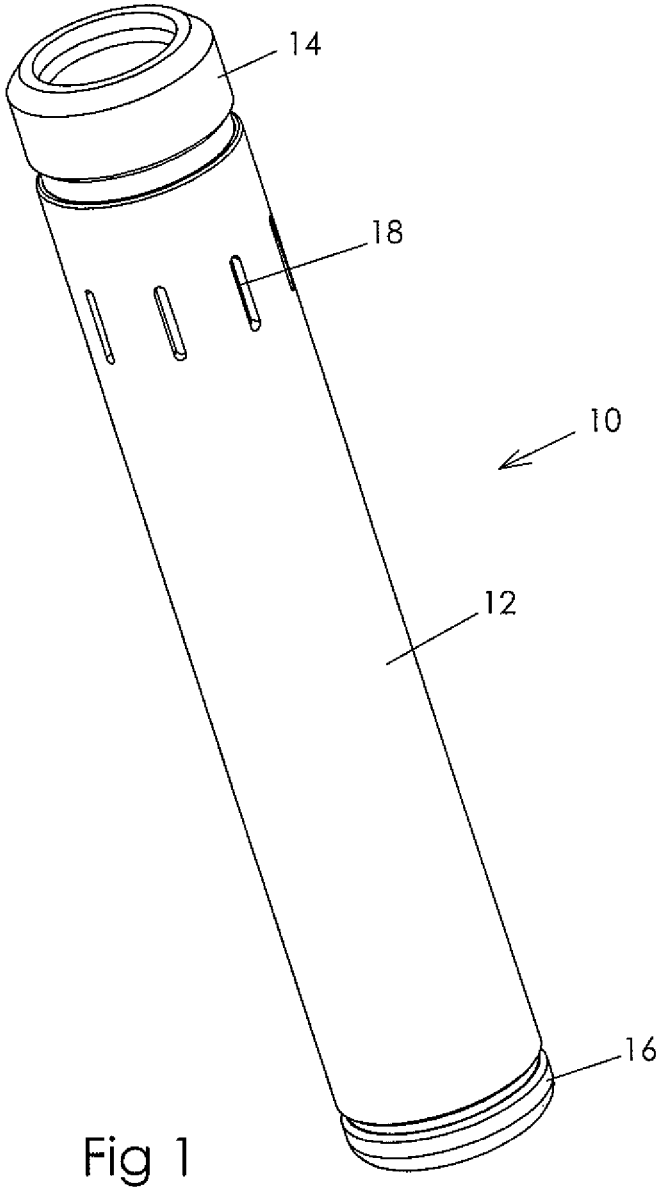
FIG. 1 is a pictorial view of a suitable gas separator according to the present invention.

FIG. 1 illustrates one embodiment of a separator 10 including a tubular outer housing 12. Coupling 14 is provided for interconnection to a tubular (not shown) which runs the separator in a well, with the coupling 14 also threadably connected to the housing 12. The plug 16 at the lower end of housing 12 is provided for ensuring that fluid which enters the housing exits the separator at the top of the housing and flows through the run in tubular to the surface. A downhole lift pump is also provided in the tubular string, conventionally directly above the separator. A plurality of axially elongate and circumferentially short opening slots 18 are provided about the housing to allow fluid to enter the interior of the housing from the annulus surrounding the housing.

Figure 2:
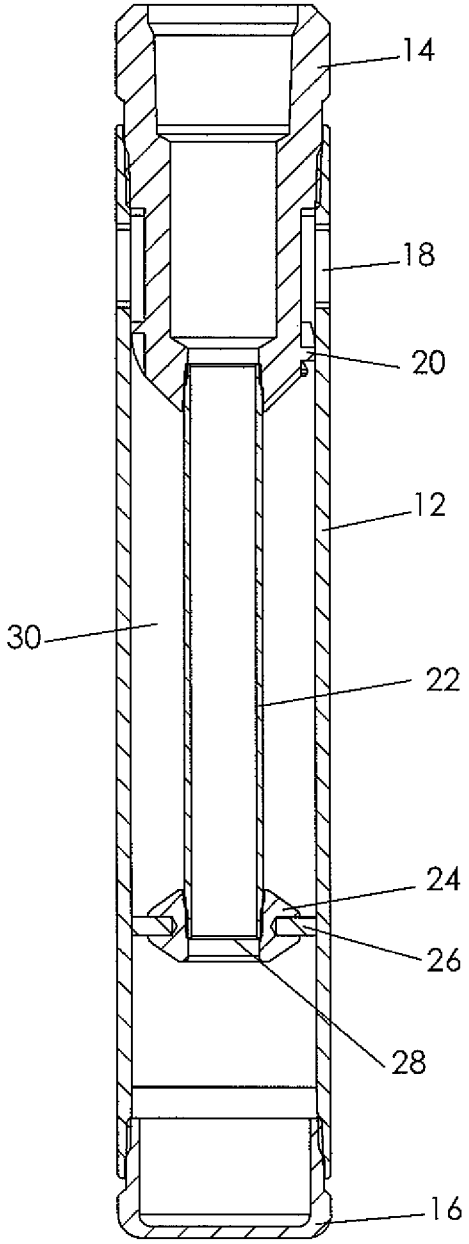
FIG. 2 is a cross sectional view of a gas separator shown in FIG. 1.

FIG. 2 is a cross-sectional view of the separator shown in FIG. 1, and depicts the interconnection between the coupling 14 and the housing 12. A vortex flow igniter or spiral gas separator 20 is provided at the lower end of or below the coupling 14 and below the openings 18, such that fluid entering the housing must pass downward past the spiral gas separator 20 before exiting the housing. An inner tube 22 is provided between the lower end of the coupling 14, and a centralizer 24 with a plurality of circumferentially spaced pins 26 maintain the tubular 22 centered within the housing 12. Well fluid from the annulus thus enters the separator through the openings 18, pass by the spiral gas separator 20, flow downward past the lower end of the inner tubular 22, enter the lower end 28 of the tubular, and then flow upward through the tubular 22 to the coupling 14, and then to the run-in tubular to the surface.

The separator vanes 21 perform the function of swirling the well fluids and the gas, so that the heavier well fluids migrate to the wall of the housing 12 while the lighter gas migrates towards the upper end of the chamber 30 between the inner tube 22 and the outer housing 12, and generally tend to migrate towards the inner tube 22. The above action is occurring while fluids are being pumped to the surface, i.e., during the upstroke of the beam pump. During the down stroke of the beam pump, well fluids are not drawn through the opening 18, but instead the gas accumulating in the chamber 30 passes upward past the spiral vanes 20 and exits the separator through the openings 18. The gas then continues upward in the well, and is not drawn into the pump.

Figure 3:
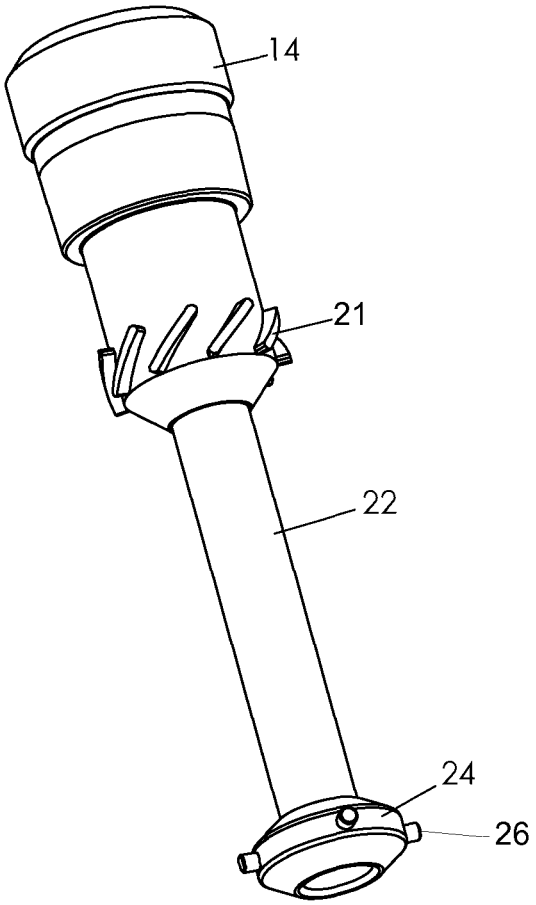
FIG. 3 shows a portion of the gas separator with the separator body and plug removed.

FIG. 3 more clearly shows the vanes 20 circumferentially arranged about the coupling 14 for causing a spiraling or vortex flow to the well fluids, thereby separating fluids from gas, as discussed above. The vanes 21 are stationary with respect to both the outer housing 12 and the inner tube 22. The open lower end of the inner tube 22 is below the vortex flow generator 20 by a distance greater than three times an outer diameter of the housing 12, and in some applications is below greater than five times the outer diameter of the housing 12. FIG. 3 also depicts a centralizer 24 for centering the inner tubular 22 within the housing.

Figure 4:
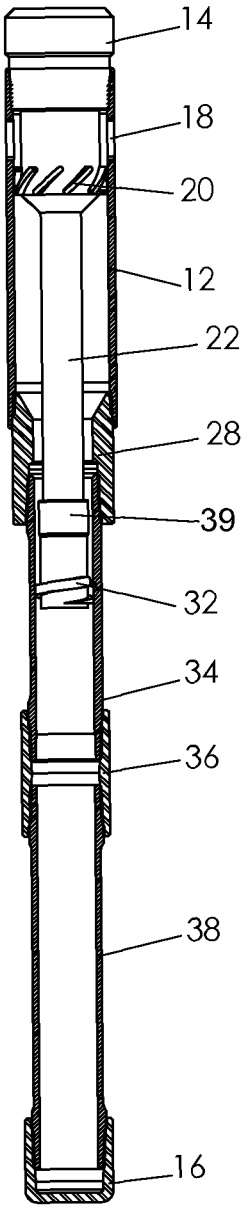
FIG. 4 is a cross-sectional view of a gas separator and desander.

FIG. 4 depicts another embodiment of the invention, with the upper end of a separator being substantially similar to the separator discussed above. Coupling 28 interconnects the lower end of the housing 12 to the downwardly extending tubular 34. Coupling 39 interconnects the inner tube 22 with a spiral desander 32 which is positioned within the tubular 34, and includes one or more spiraling vanes extending outward from the tubular 22. The desander 32 can axially separate sand and other solid particles from the well fluids, and the spiraling action of the desander causes sand to migrate to the wall of the tubular 34, while well fluids are drawn up through the bottom of the tubular 22. Coupling 36 interconnects the tubular 34 with a lower tubular 38, and plug 16 is provided at the lower end of tubular 38. The tubular 38 provides a storage chamber for sand, so that sand may accumulate within the separator without flowing into the down-hole pump. Those skilled in the art will appreciate that, depending on the well conditions, tubular 38 may be 10 feet long or may be several hundred feet long, depending on the estimated quantity of sand which would be trapped in the separator will now flow upward through the pump with the well fluids.

The FIG. 4 embodiment shows the tubular 12 surrounding the gas vanes of the vortex flow generator to be larger in diameter than the tubular 34 surrounding the spiral desander 32. In other embodiments, both the tubular surrounding the vanes 20 and the tubular surrounding the spiral desander 32 may have substantially the same diameter, with both vanes 20 and spiral 32 positioned within a single uniform diameter tubular.

The gas separator described herein is particularly intended for use with downhole pumps which have an intermittent flow, such as rod pumps. The gas collects below the helical flow generator, and when the liquid flow to the surface stops on the pump down stroke, the gas escapes through the openings in the housing.

In other embodiments, two or more axially spaced gas separators may be provided. The gas would thus accumulate in the chamber below the upper gas separator, and under high gas flow conditions, some gas can pass downward through the lower separator and accumulate in the gas chamber below the lower gas separator. During the pump down stroke, gas from the upper gas separator would escape the openings in the housing, while at least some of the gas in the chamber below the lower gas separator will migrate up to the chamber below the upper gas separator, and would escape through the openings in the housing during the next pump down stroke. Depending on the length of the gas separator, more than one centralizer may also be provided to stabilize the tube 22.

In the combination vortex flow generator and sand spiral, the tubular below the sand spiral into which the sands falls may be open-ended, or the lower end of the tubular may include a dump valve. The dump valve may automatically close on the upstroke of the pump to prevent fluid from entering the tubular from below the sand spiral, and the dump valve may automatically open during the down stroke of the surface pump.

The separator is designed to reduce or eliminate large gas flow velocities in parallel or substantially parallel flow paths. Flow is downward when passing by the gas separator, and the flow of liquid is substantially upward after passing by the desander. The desander is provided adjacent to the lower end of the inner tube 22.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A downhole separator supported on a tubular string within a borehole for separating gas from well fluids, the well fluids being pumped intermittently to the surface using a cyclic pump, the downhole separator comprising:

an outer tubular housing supported by the tubular and having openings therein to receive well fluids and gas from an annulus radially exterior of the outer tubular housing;

an inner flow tube supported within the outer tubular housing by the tubular string and having an open lower end to receive well fluids for upward flow of the well fluids after separation of the gas from the well fluids; and a vortex flow generator disposed radially between the inner flow tube and the outer tubular housing and below the openings in the outer tubular housing to receive a flow of the gas and well fluids from the openings in the outer tubular housing and to impart a helical flow to the gas and well fluids to effect separation of the gas from the well fluids, the gas accumulating in an annular chamber below the vortex flow generator and between the outer tubular housing and the inner flow tube when well fluids are pumped to the surface, the annular chamber having a portion radially interior to the vortex generator;

wherein a volume of the gas and well fluids is drawn through the openings in the outer tubular housing, downwardly through the vortex flow generator, and into the annular chamber during an upstroke of a pump cycle in which well fluids are pumped from the inner flow tube to the surface;

wherein the helical flow imparted by the vortex generator to the gas and well fluids moving through the vortex generator causes the heavier well fluids to migrate towards an interior wall of the outer tubular housing and displaces the gas radially inwardly in the annular chamber; and wherein the gas displaced radially inwardly in the annular chamber flows upwardly past the vortex flow generator and exits the the downhole separator through the openings in the outer tubular housing during a downstroke of the pump cycle during which the pump does not pump well fluids to the surface.

2. The downhole separator of claim 1, wherein the outer tubular housing is positionable within an outer casing within the borehole.

3. The downhole separator of claim 1, wherein the open lower end of the inner flow tube is below the vortex flow generator by a distance greater than at least three times an outer diameter of the outer tubular housing.

4. The downhole separator of claim 1, further comprising: a plug at a lower end of the outer tubular housing.

5. The downhole separator of claim 1, wherein the vortex flow generator includes a plurality of radially outwardly extending vanes for directing well fluid in a helical flow.

6. The downhole separator of claim 5, wherein the vanes on the vortex flow generator are stationary with respect to the outer tubular housing and the inner flow tube.

7. The downhole separator of claim 1, further comprising:

a sand spiral supported by the inner flow tube and below the vortex flow generator for separating sand from the well fluids, the sand accumulating in a chamber within the outer tubular housing below the sand spiral.

8. The downhole separator of claim 7, wherein the sand spiral includes one or more spiraling vanes each extending radially from the inner flow tube.

9. The downhole separator of claim 1, wherein the openings are circumferentially spaced about the outer tubular housing and each of the openings is axially elongate compared to a circumferential width of each opening.

10. A downhole separator supported on a tubular string within a borehole for separating gas from well fluids, the well fluids being pumped intermittently to the surface, the downhole separator comprising:

an outer tubular housing supported by the tubular and having openings therein to receive well fluids and gas from an annulus radially exterior of the outer tubular housing;

an inner flow tube supported within the outer tubular housing by the tubular string and having an open lower end to receive a flow of well fluids after separation of the gas from the well fluids;

a vortex flow generator including a plurality of radially outwardly extending vanes positioned radially between the inner flow tube and the outer tubular housing to receive the well fluids from the openings and to impart a helical flow to effect separation of the gas from the well fluids, the vanes being stationery with respect to the inner flow tube, the gas accumulating in an interior portion of an annular chamber below the vortex flow generator and between the outer tubular housing and the inner flow tube during a pump upstroke in which well fluids are pumped from the open lower end of the inner flow tube towards the surface; and the accumulated gas in the interior portion of the annular chamber flows upwardly from the annular chamber, through the vortex flow generator and exits the downhole separator through the openings in the outer tubular housing during a pump downstroke in which the pump does not pump well fluids towards the surface.

11. The downhole separator of claim 10, wherein the open lower end of the inner flow tube is below the vortex flow generator by a distance greater than at least three times an outer diameter of the outer tubular housing.

12. The downhole separator of claim 10, further comprising:

a sand spiral supported as the inner flow tube and below the vortex flow generator for separating sand from the well fluids, the sand accumulating in a chamber within the outer tubular housing below the sand spiral.

13. The downhole separator of claim 12, wherein the sand spiral includes one or more circumferentially spaced vanes.

14. The downhole separator claim 10, wherein the openings are circumferentially spaced about the outer tubular housing and each opening is axially elongate compared to a circumferential width of each opening.

15. A downhole separator supported on a tubular string within a borehole for separating gas from well fluids, the well fluids being pumped intermittently to the surface using a pump that cycles between an upstroke and a downstroke, the downhole separator comprising:

an outer tubular housing supported by the tubular string and having openings therein to receive well fluids and gas from an annulus radially exterior of the outer tubular housing;

an inner flow tube supported by the tubular string and having an open lower end to receive a flow of well fluids after separation of the gas from the well fluids;

a vortex flow generator radially between the inner flow tube and the outer tubular housing to receive the gas and well fluids entering the downhole separator through the openings in the outer tubular housing and to impart a helical flow to effect separation of the gas from the well fluids, the vortex flow generator including a plurality of radially extending vanes stationery with respect to the inner flow tube, the gas accumulating in an annular chamber below the vortex flow generator and between the outer tubular housing and the inner flow tube when well fluids are pumped to the surface, the annular chamber having a portion that is radially interior to the vortex flow generator for accumulation of gas separated from the well fluids;

wherein the accumulated gas from the radially interior portion of the annular chamber flows upwardly through the vortex flow generator and exits the openings in the outer tubular housing when the pump is on a downstroke; and a sand spiral supported as the inner flow tube and below the vortex flow generator for separating sand from the well fluids, the sand accumulating in a chamber within the outer tubular housing below the sand spiral.

16. The downhole separator of claim 15, wherein the open lower end of the inner flow tube is below the vortex flow generator by a distance greater than at least three times an outer diameter of the outer tubular housing.

17. The downhole separator of claim 15, further comprising:

a plug at a lower end of the downhole tubular housing.

18. The downhole separator of claim 15, wherein the sand spiral includes one or more spiraling vanes each extending radially from the inner flow tube.

19. The downhole separator claim 15, wherein the openings are circumferentially spaced about the outer tubular housing and each opening is axially elongate compared to a circumferential width of the opening.

* * * * *